US009328423B2

(12) United States Patent
Hashimoto

(10) Patent No.: US 9,328,423 B2
(45) Date of Patent: May 3, 2016

(54) LIQUID TRIVALENT CHROMATE FOR ALUMINIUM OR ALUMINIUM ALLOY AND METHOD FOR FORMING CORROSION-RESISTANT FILM OVER SURFACE OF ALUMINIUM OR ALUMINIUM ALLOY BY USING SAME

(75) Inventor: Akira Hashimoto, Tokyo (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 781 days.

(21) Appl. No.: 11/450,163

(22) Filed: Jun. 9, 2006

(65) Prior Publication Data

US 2007/0089808 A1 Apr. 26, 2007

Related U.S. Application Data

(63) Continuation of application No. PCT/JP2004/018258, filed on Dec. 8, 2004.

(30) Foreign Application Priority Data

Dec. 9, 2003 (JP) ..... 2003-410507

(51) Int. Cl.
*C23C 22/30* (2006.01)
*C23C 22/34* (2006.01)
*C23C 22/56* (2006.01)

(52) U.S. Cl.
CPC ..... *C23C 22/34* (2013.01); *C23C 2222/10* (2013.01)

(58) Field of Classification Search
CPC ..... C23C 2222/10; C23C 22/34
USPC ..... 148/267
See application file for complete search history.

(56) References Cited

U.S. PATENT DOCUMENTS

| | | | | | |
|---|---|---|---|---|---|
| 4,349,392 | A * | 9/1982 | Huvar | ..... | 148/266 |
| 4,578,122 | A * | 3/1986 | Crotty | ..... | 148/267 |
| 6,447,620 | B1 * | 9/2002 | Komiyama et al. | ..... | 148/251 |
| 7,101,469 | B2 * | 9/2006 | Kochilla et al. | ..... | 205/317 |
| 2003/0145909 | A1 | 8/2003 | Diaddario, Jr. et al. | | |

FOREIGN PATENT DOCUMENTS

| | | | | |
|---|---|---|---|---|
| EP | 1 318 212 | A1 | 6/2003 | |
| GB | 2 097 024 | A | 10/1982 | |
| JP | 07-126859 | | 5/1995 | |
| JP | 2002-332575 | * | 11/2002 | ..... C23C 22/78 |
| SU | 1450400 | * | 11/1990 | ..... C23C 22/34 |
| SU | 1450400 | A1 | 11/1990 | |
| WO | WO 02/20874 | A2 | 3/2002 | |
| WO | WO 03/054249 | A1 | 7/2003 | |
| WO | WO 2004/065058 | A2 | 8/2004 | |
| WO | WO 2004/065642 | A2 | 8/2004 | |

OTHER PUBLICATIONS

Supplementary European Search Report for EP 04820216.2 dated Dec. 20, 2010.

* cited by examiner

*Primary Examiner* — Lois Zheng
(74) *Attorney, Agent, or Firm* — Hoffmann & Baron, LLP

(57) ABSTRACT

The object of the present invention is to provide a method for forming a coating on the surface of an aluminum or aluminum alloy using a trivalent chromate solution which dose not contain any harmful hexavalent chromium, in which the coating has an excellent corrosion resistance and adhesion with paints.

The present invention provides a hexavalent chromium free trivalent chromate solution for an aluminum or aluminum alloy, in which the concentration of a trivalent chromium is in the range of from 0.01 to 100 g/L, the concentration of a metal selected from the group consisting of zinc, cobalt, nickel and a combination thereof is in the range of from 0.01 to 100 g/L and the concentration of a fluorine is in the range of from 0.01 to 50 g/L.

7 Claims, No Drawings

LIQUID TRIVALENT CHROMATE FOR ALUMINIUM OR ALUMINIUM ALLOY AND METHOD FOR FORMING CORROSION-RESISTANT FILM OVER SURFACE OF ALUMINIUM OR ALUMINIUM ALLOY BY USING SAME

CROSS-REFERENCE TO RELATED APPLICATIONS

This application is a continuation of International Application No. PCT/JP2004/018258, filed Dec. 8, 2004, which claims priority to Japanese Patent Application No. 2003-410507, filed Dec. 9, 2003, the contents of each of which are incorporated herein by reference.

TECHNICAL FIELD

The present invention relates to a trivalent chromate solution for an aluminium or aluminium alloy and a method for forming a corrosion resistant coating on the surface of an aluminium or aluminium alloy using it.

BACKGROUND ART

An aluminium or aluminium alloy is often used in the field unsuitable for steel because it is light and easy to process and cast, as well as because of its property such as light, heat, electrical or vacuum property. In addition, the technological progress makes it to be easily joined, so it is utilized not only in the filed of building and transportation but also in the various fields such as automobile, electric car, airplane and consumer electronics. In recent years, furthermore, the amount of recycled aluminium is also large for various reasons such as environmental issue and being easy to recycle aluminium, then the demand is tending to increase.

In these circumstances, for aluminium and aluminium alloy, a surface treatment such as hexavalent chromate treatment for the purpose of improvement in its corrosion resistance and the adhesion with paints is applied. However, said hexavalent chromate uses hexavalent chromium as main component, so hexavalent chromium is contained not only in the treatment solution but also in the hexavalent chromium coating. This hexavalent chromium is pointed out to have a bad influence upon human body and environment, so that the motion to restrain the use of hexavalent chromium has become brisk recently.

Although the surface treatment method free from hexavalent chromium using trivalent chromium has been disclosed as one of the alternate techniques (for example, JP-A-6-173027, JP-A-7-126859, JP-A-11-152588 and JP-A-11-335865) (the term "JP-A" as used herein means an "unexamined published Japanese patent application"), such a method has not adequate corrosion resistance and adhesion with paints equivalent to those of hexavalent chromium and thus, under the present situation, said method is not industrialized.

DISCLOSURE OF THE INVENTION

The object of the present invention is to provide a method for forming a coating on the surface of an aluminium or aluminium alloy using a trivalent chromate solution which does not contain any harmful hexavalent chromium, in which said coating has an excellent corrosion resistance and adhesion with paints.

The present invention is based on the findings that the above-mentioned problems can efficiently be solved using a trivalent chromate solution containing a metal selected from the group consisting of zinc, cobalt, nickel and a combination thereof and a fluorine to form a trivalent chromate coating on the surface of an aluminium or aluminium alloy.

The present invention, therefore, provides a hexavalent chromium free trivalent chromate solution for an aluminium or aluminium alloy, in which the concentration of the trivalent chromium is in the range of from 0.01 to 100 g/L, the concentration of the metal selected from the group consisting of zinc, cobalt, nickel and a combination thereof is in the range of from 0.01 to 100 g/L, the concentration of the fluorine is in the range of from 0.01 to 50 g/L.

Moreover, the present invention provides a method for forming a corrosion resistant coating on the surface of an aluminium or aluminium alloy, comprising a step of contacting the surface of an aluminium or aluminium alloy with the trivalent chromate solution according to any one of claims 1 to 3.

According to the present invention, a coating which has an excellent corrosion resistance and adhesion with paints can be formed on the surface of an aluminium or aluminium alloy. Therefore, it can be expected to be used widely and safely in various fields in future without using harmful hexavalent chromium which has been used until now.

BEST MODE FOR CARRYING OUT THE INVENTION

The substrate used in the present invention may include those in various shapes such as platy substance, rectangular parallelepiped, columnar, cylindrical or globular substance or die casting or molding of aluminium or aluminium alloy.

The trivalent chromate solution according to the present invention contains trivalent chromium, a metal selected from the group consisting of zinc, cobalt, nickel and a combination thereof, and fluorine.

One or more sources selected from the group consisting of trivalent chromium salt such as chromium chloride, chromium sulfate, chromium nitrate and chromium acetate, and trivalent chromium which is formed by reducing the hexavalent chromium of hexavalent chromium salt such as chromate and dichromate with reducing agent into trivalent condition can be used as the source of trivalent chromium. The concentration of trivalent chromium is preferably in the range of from 0.01 to 100 g/L in aqueous solution, more preferably in the range of from 0.05 to 20 g/L. If the concentration of trivalent chromium is within the above range, stable trivalent chromium coating can continuously be formed resulting in excellent corrosion resistance.

The source of zinc may include zinc compound such as zinc chloride, zinc sulfate, zinc nitride, zinc acetate, zinc hydroxide, zinc oxide, zinc carbonate and the like. One or a combination of two or more of these zinc compounds can be used. The concentration of zinc is preferably in the range of from 0.01 to 100 g/L in aqueous solution, more preferably in the range of from 0.05 to 20 g/L.

The source of cobalt may include cobalt compound such as cobalt chloride, cobalt sulfate, cobalt nitride, cobalt acetate and the like. One or a combination of two or more of these cobalt compounds can be used. The concentration of cobalt is preferably in the range of from 0.01 to 100 g/L in aqueous solution, more preferably in the range of from 0.1 to 50 g/L.

The source of nickel may include nickel compound such as nickel chloride, nickel sulfate, nickel nitride, nickel acetate and the like. One or a combination of two or more of these nickel compounds can be used. The concentration of nickel is preferably in the range of from 0.01 to 100 g/L in aqueous solution, more preferably in the range of from 0.1 to 50 g/L.

When a combination of two or more of the above metals is used, the total concentration of metals is preferably in the range of from 0.01 to 100 g/L in aqueous solution, more preferably in the range of from 0.1 to 50 g/L.

The source of fluorine may include fluorine compound such as hydrogen fluoride, sodium fluoride, ammonium fluoride, potassium fluoride, sodium hydrogen fluoride, ammonium hydrogen fluoride, potassium hydrogen fluoride, silicofluoride and borofluoride. One or a combination of two or more of these fluorine compounds can be used. The concentration of fluorine is preferably in the range of from 0.01 to 50 g/L in aqueous solution, more preferably in the range of from 0.05 to 10 g/L.

The pH of the trivalent chromate solution according to the present invention is preferably in the range of from 0.5 to 6, more preferably in the range of from 1.0 to 4.0. Here, in order to adjust pH, inorganic acids such hydrochloric acid, sulfuric acid and nitric acid and alkaline agents such as alkali hydroxide and aqueous ammonia can be used.

In addition, the trivalent chromate solution according to the present invention can attain adequate corrosion resistance without using phosphorus compounds. Conversely, the existence of phosphorus in the trivalent chromate solution according to the present invention is not preferable because of the formation of precipitation.

The residue of the above-mentioned essential components in the treatment solution used in the present invention is a water.

The method for forming the trivalent chromate coating according to the present invention comprises a step of contacting the surface of an aluminium or aluminium alloy with the above-mentioned trivalent chromate solution. In addition, if necessary, any treatments such as washing with water and drying may be carried out after the formation of the corrosion resistant coating. The step of contacting the surface of an aluminium or aluminium alloy with the above-mentioned trivalent chromate solution may include, for example, dipping the surface of an aluminium or aluminium alloy in the above-mentioned trivalent chromate solution, spraying the above-mentioned trivalent chromate solution onto the surface of an aluminium or aluminium alloy and the like. In dipping the surface of an aluminium or aluminium alloy in the above-mentioned trivalent chromate solution, for example, it is preferable that the solution temperature is from 10 to 80° C. and the dipping time is from 5 to 600 seconds, and it is more preferable that the solution temperature is from 20 to 60° C. and the dipping time is from 5 to 120 seconds. Moreover, the thickness of the formed trivalent chromate coating is preferably from 0.01 to 2 μm, more preferably form 0.02 to 0.5 μm.

In addition, if necessary, the same treatments such as degreasing, etching and activating as those in the case of forming conventional hexavalent chromate coating can be performed as pretreatment for the surface of an aluminium or aluminium alloy.

Furthermore, for the purpose of improvement in corrosion resistance and appearance, coloring and the like, over-coat including paint or the like can be also applied after the formation of the trivalent chromate coating.

EXAMPLES

The surface of an aluminium or aluminium alloy was degreased, etched (see Examples) and activated, and then a trivalent chromate coating was formed thereon, as described below. Here, washing with water was carried out between each of steps and it was dried after the formation of the trivalent chromate coating.

Degreasing was performed using AL-47 manufactured by DIPSOL CHEMICALS CO., LTD. (30 mL/L: dipped at 50° C. for 5 minutes).

Etching was performed using #91 manufactured by DIPSOL CHEMICALS CO., LTD. (25 g/L: dipped at 50° C. for 30 seconds).

Activating was performed using 62% nitric acid (500 mL/L) or ALZ-740 manufactured by DIPSOL CHEMICALS CO., LTD. (150 g/L)+62% nitric acid (750 mL/L) (dipped at room temperature for 20 seconds).

Drying was performed at 60° C. for 10 minutes.

The method for evaluating corrosion resistance according to JIS Z2371 was used to carry out a 5% salt-water spray test at 35° C., and then the area of generated rust after 240 hours was evaluated in five ranks.

In the evaluation of adhesion, a sample which had been allowed to stand for 24 hours after forming trivalent chromate coating and drying was dipped in a solvent type paint, baked and allowed to stand for another 24 hours. The resulting sample was then dipped in boiled purified water for 1 hour, taken out, allowed to stand for about one hour, and then cross-hatch adhesion test and tape-peeling test were performed to evaluated in five ranks.

Example 1

A1100 (aluminium plate: 50×70×0.8 mm) was degreased, activated and then dipped in aqueous solution containing 5 g/L of chromium nitrate, 1 g/L of zinc sulfate and 1 g/L of ammonium fluoride at 30° C. for 30 seconds, and then washed with water and dried. The pH of the trivalent chromate solution was 2 and the thickness of the trivalent chromate coating was 0.06 μm.

Example 2

A2017 (aluminium alloy plate: 50×70×0.8 mm) was degreased, activated and then dipped in aqueous solution containing 5 g/L of chromium nitrate, 1 g/L of zinc sulfate and 1 g/L of ammonium fluoride at 30° C. for 30 seconds, and then washed with water and dried. The pH of the trivalent chromate solution was 2 and the thickness of the trivalent chromate coating was 0.13 μm.

Example 3

ADC12 (aluminium die casting plate: 50×70×3 mm) was degreased, etched, activated and then dipped in aqueous solution containing 5 g/L of chromium nitrate, 1 g/L of zinc sulfate and 1 g/L of ammonium fluoride at 30° C. for 30 seconds, and then washed with water and dried. The pH of the trivalent chromate solution was 2.

Example 4

A2017 (aluminium alloy plate: 50×70×0.8 mm) was degreased, activated and then dipped in aqueous solution containing 5 g/L of chromium nitrate, 2 g/L of cobalt sulfate and 1 g/L of ammonium fluoride at 30° C. for 30 seconds, and then washed with water and dried. The pH of the trivalent chromate solution was 2.

Example 5

A2017 (aluminium alloy plate: 50×70×0.8 mm) was degreased, activated and then dipped in aqueous solution containing 5 g/L of chromium nitrate, 2 g/L of zinc sulfate, 5 g/L of cobalt sulfate and 1 g/L of ammonium hydrogen fluoride at 30° C. for 30 seconds, and then washed with water and dried. The pH of the trivalent chromate solution was 2 and the thickness of the trivalent chromate coating was 0.15 μm.

Comparative Example 1

A1100 (aluminium plate: 50×70×0.8 mm) was degreased, activated and then dipped in aqueous solution containing 10 g/L of chromium trioxide and 1 g/L of ammonium hydrogen fluoride at 25° C. for 60 seconds, and then washed with water and dried. The pH of the hexavalent chromate solution was 1 and the thickness of the hexavalent chromate coating was 0.06 μm.

Comparative Example 2

A2017 (aluminium alloy plate: 50×70×0.8 mm) was degreased, activated and then dipped in aqueous solution containing 10 g/L of chromium trioxide and 1 g/L of ammonium hydrogen fluoride at 25° C. for 120 seconds, and then washed with water and dried. The pH of the hexavalent chromate solution was 1 and the thickness of the hexavalent chromate coating was 0.03 μm.

The results obtained are shown in Table 1 below. Each trivalent chromate coating of Examples 1 to 5 has a corrosion resistance and an adhesion equivalent to each hexavalent chromate coating of Comparative Example 1 and 2.

TABLE 1

| | concentration [g/L] | | | | salt-water | |
|---|---|---|---|---|---|---|
| | trivalent chromium | zinc | cobalt | fluorine | spray test | adhesion |
| Example 1 | 1.1 | 0.2 | 0 | 0.5 | 1 | 1 |
| Example 2 | 1.1 | 0.2 | 0 | 0.5 | 2 | 1 |
| Example 3 | 1.1 | 0.2 | 0 | 0.5 | 2 | 1 |
| Example 4 | 1.1 | 0 | 0.4 | 0.5 | 2 | 1 |
| Example 5 | 1.1 | 0.5 | 1.0 | 0.5 | 2 | 1 |
| Comparaitve 1 | 5.2 (hexavalent chromium) | 0 | 0 | 0.7 | 1 | 1 |
| Comparaitve 2 | 5.2 (hexavalent chromium) | 0 | 0 | 0.7 | 2 | 1 |

[Salt-water spray test]
1: rust of 0%
2: rust of less than 5%
3: rust of less than 10%
4: rust of less than 50%
5: rust of not less than 50%
[Adhesion]
1: no peeling
2: peeling of less than 5%
3: peeling of less than 10%
4: peeling of less than 50%
5: peeling of not less than 50%

The invention claimed is:

1. A hexavalent chromium free trivalent chromate solution for an aluminium or aluminium alloy, the solution consisting of a source of the trivalent chromium, a source of a metal selected from the group consisting of zinc, cobalt, and a combination thereof, a source of fluorine, a pH adjuster and water, in which the concentration of a trivalent chromium is in the range of from 1.1 to 20 g/L, the concentration of zinc, when present, is in the range of from 0.05 to 20 g/L, the concentration of cobalt, when present, is in the range of from 0.1 to 50 g/L, the concentration of fluorine is in the range of from 0.5 to 10 g/L, the pH is in the range of from 1.0 to 4.0, and the pH adjuster is selected from the group consisting of inorganic acids and alkaline agents.

2. The trivalent chromate solution according to claim 1, wherein said metal is zinc.

3. A method for forming a corrosion resistant coating on the surface of an aluminium or aluminium alloy, comprising a step of contacting said surface of an aluminium or aluminium alloy with the trivalent chromate solution according to claim 1.

4. The method according to claim 3, in which the step of contacting comprises dipping the surface of the aluminium or aluminium alloy in the trivalent chromate solution at the temperature of from 10 to 80 ° C for from 5 to 600 seconds.

5. The method according to claim 3, in which the step of contacting comprises spraying the trivalent chromate solution according to claim 1 onto the surface of an aluminium or aluminium alloy.

6. The method according to claim 3, in which further comprises degreasing and activating the surface of an aluminium or aluminium alloy.

7. The method according to claims 6, in which further comprises etching the surface of an aluminium or aluminium alloy.

* * * * *